US007533547B2

(12) United States Patent
Büchle et al.

(10) Patent No.: US 7,533,547 B2
(45) Date of Patent: May 19, 2009

(54) CUTTING NEEDLE WITH INTERCHANGEABLE KNIFE

(75) Inventors: Günther Büchle, Bad-Waldsee (DE); Eric Jürgens, Bisingen (DE); Jörg Sauter, Albstadt (DE)

(73) Assignee: Groz-Beckert KG, Albstadt (DE)

( * ) Notice: Subject to any disclaimer, the term of this patent is extended or adjusted under 35 U.S.C. 154(b) by 0 days.

(21) Appl. No.: 12/146,970

(22) Filed: Jun. 26, 2008

(65) Prior Publication Data

US 2009/0000338 A1 Jan. 1, 2009

(30) Foreign Application Priority Data

Jun. 26, 2007 (EP) ..... 07012443

(51) Int. Cl.
*D04B 35/02* (2006.01)

(52) U.S. Cl. ..... 66/123; 66/116

(58) Field of Classification Search ..... 66/116, 66/119, 120, 121, 123
See application file for complete search history.

(56) References Cited

U.S. PATENT DOCUMENTS

| | | | | | |
|---|---|---|---|---|---|
| 1,120,989 | A * | 12/1914 | Williams | 66/121 |
| 2,335,075 | A * | 11/1943 | Needham | 66/8 |
| 3,040,551 | A * | 6/1962 | Urlaub | 66/197 |
| 4,026,126 | A * | 5/1977 | Nuber | 66/9 R |
| 4,089,192 | A * | 5/1978 | Kohorn | 66/123 |
| 4,537,048 | A * | 8/1985 | Gutschmit et al. | 66/93 |
| 6,298,693 | B1 * | 10/2001 | Schaffer | 66/123 |
| 6,612,135 | B1 * | 9/2003 | Pinzauti | 66/93 |
| 6,807,831 | B2 * | 10/2004 | Roth | 66/123 |

* cited by examiner

*Primary Examiner*—Danny Worrell
(74) *Attorney, Agent, or Firm*—Fitch, Even, Tabin & Flannery; Norman N. Kunitz

(57) ABSTRACT

A cutting needle (1) for knitting machines and similar applications has been provided, said cutting needle having a needle body (2) on which a knife (6) is detachably held, preferably by means of a detent device (19). Such a cutting needle (1) reduces the maintenance costs of knitting machines and discloses ways for optimizing needle bodies (2) and knives (6) in view of manufacturing technology and materials.

6 Claims, 4 Drawing Sheets

CUTTING NEEDLE WITH INTERCHANGEABLE KNIFE

CROSS-REFERENCE TO RELATED APPLICATION

This application claims the priority of European Patent Application No. 07 012 443.3, filed Jun. 26, 2007, the subject matter of which, in its entirety, is incorporated herein by reference.

BACKGROUND OF THE INVENTION

Cutting needles are used in knitting machines, for example for the production of cut plush, said cutting needles having a needle body with a hook on one end and, in the vicinity thereof, a knife section. The knife section has a highly sharpened cutting edge that is disposed to cut open stitches. If the knife section has become blunt due to extended use, the quality of the knit material suffers. Then, the cutting needle must be exchanged.

Considering this, it is the object of the invention to provide an improved cutting needle.

SUMMARY OF THE INVENTION

The above object generally is achieved with the cutting needle in accordance with the invention which has a needle body, as well as a knife, that is detachably connected to the needle body. This feature allows the replacement of the worn knife and its replacement with a new highly sharpened knife. It is also possible to take a worn knife out of the cutting needle and to re-sharpen it by itself.

The cutting needle may remain in the knitting machine when the knife needs to be exchanged. It is not necessary to open the knitting machine lock. This significantly facilitates maintenance of the knitting machine when the cutting edges of the cutting needles have become blunt.

Preferably, the cutting needle has a seat for the accommodation and the support of the knife. This seat may be configured, for example, to represent a slit which extends through the needle body. Preferably, the slit is arranged in the vicinity of the hook, viewed in longitudinal direction of the needle body. A knife is held between the slit flanks. Said knife is seated in the slit, preferably with extremely minimal lateral play, so that said knife is set in a precise manner. The slit is placed in the needle body, preferably centered. It is laterally delimited by strips or slit walls. The slit walls are part of the needle base body and preferably have parallel flanks. The slit width and the cross-section of the slit walls may have approximately the same dimensions. Preferably, they each account for a third of the needle thickness in the slit region. However, depending on the field of application, the thickness ratios may vary. For example, when a cutting knife having a great thickness is used, the slit width may be greater than one third of the needle thickness in the slit region. The slit width may account for half of the needle thickness and may even be greater in special cases. When a very fine cutting knife is used, the slit width may be very small; it may then account for, e.g., only 20% of the needle thickness in the slit region, or it may even be less.

The knife mount formed by the slit preferably comprises at least one positive-locking holding means for supporting the knife. This positive-locking holding means is in engagement with the knife in order to support said knife on at least one of its ends or in a region close to the end. For example, the positive-locking holding means is a first projection extending into the slit, said projection being accommodated by a recess of the knife. The recess may have the form of an opening that ends on both flat sides of the knife and thus traverses the knife, or said recess may be provided on the front end of the knife that faces the hook. These positive-locking means may form a pivoting hinge that supports the knife on its front, hook-side end.

Furthermore, a moment support surface for the knife may be provided on the needle body. This surface may preferably be located on one end of the slit that is at a distance from the positive-locking holding means. This surface is disposed to absorb and counter a pressure force exerted on the knife by the thread, said knife becoming gradually blunt. Preferably, the moment support surface is a preferably flat surface extending in the longitudinal direction of the needle body. Preferably, this surface is oriented approximately radially with respect to the pivot axis of the aforementioned hinge means.

A detachable connecting means may be used to achieve the detachable connection of the knife with the needle body. This connecting means may be a detent device that is provided at a point that is at a distance from the positive-locking holding means. The detent device may, e.g., be a snap-in tongue formed on the knife, whereby said snap-in tongue may come into locking connection with the second projection provided in the slit. The snap-in tongue is preferably oriented in a direction transverse to the longitudinal direction of the needle body. Referring to the pivot axis defined by the positive-locking connecting means, the snap-in tongue is preferably oriented in circumferential direction. The snap-in tongue, in turn, is preferably an integral part of the knife. This can be achieved in that the knife is provided with slit-like recesses, between which the tongue consisting of the material of the knife comes to a stop. On its free end, said tongue is preferably provided with a detent depression that can come into engagement on the needle body.

The detachable connecting means, e.g., in the form of a detent device, may be provided at the same location as the holding means, in which case it represents the holding means. The detent device may be an elevation, for example, said elevation extending into an opening of the knife and thus holding and fixing in place said knife by positive-locking engagement. The elevation may have the form of a pin that consists of the material of a slit wall. The size and the dimensions of the opening of the cutting knife and the elevation of the slit wall may be adapted to each other in such a manner that the cutting knife—after it has been mounted—is axially fixed in the slit of the needle base body. For radial fixation, a second detent device of the same or of a similar type may be provided at a distance from the first detent device. Preferably, one of these two detent means is arranged in the front end region of the cutting knife and the other holding or detent means is arranged in the rear end region of the cutting knife. For fixation of the cutting knife, it is possible to provide two elevations per opening in the cutting knife. Each elevation extends from a slit wall and projects into the opening of the cutting knife. The two elevations may be mirror-symmetrical and may be located exactly opposite each other. In order to fix the cutting knife in position in the needle base body, an opening may have a shape that is different from the shape of an elevation. For example, an opening may be configured as an elongated hole. The elevations of the two slit walls may then be preferably laterally offset, so that one elevation projects into the rear region of the elongated hole and the opposing elevation projects into the front region of the elongated hole. The height of the elevations may be very minimal. If two elevations project into one opening, the sum of the height of the two elevations may be less than the width of the cutting knife or the length of an opening. Then, preferably, there is a distance between the two elevations that project into one opening. The elevations may have the most diverse forms; for example, they may have a cylindrical, a spherical or an otherwise curved form.

Referring to a preferred embodiment of the cutting needle, an axial locking device that acts between the knife and the needle body is provided. This axial locking device is disposed to prevent axial forces acting on the knife during operation from acting, in particular, on the detent device of the knife and to ensure that the knife will not move in axial direction on the needle base body during operation. The axial locking device may represent positive-locking interacting means that are effective between the knife and the needle base body. Preferably, the axial locking device has at least one abutment surface for the knife, said abutment surface opposing an axial movement of the knife toward the locking device. This means, for example, that the abutment surface of the axial locking device provided on the needle base body preferably faces toward the positive-locking connecting means. Such an abutment surface may be provided, for example, on a strip provided in the slit, said strip being located between the detent device the positive-locking connecting means. Alternative axial locking devices may be provided, said devices acting on an end surface of the knife, for example.

Independent of the specific configuration of the connecting means that supports the knife on the needle body, the present invention permits a simple and fast change of worn knives and thus a significantly sped-up maintenance of knitting machines. In addition, the present invention permits the separate manufacture of knives and needle bodies of different materials that are optimally designed for their respective purposes of use due to the implementation of different manufacturing technologies that have been optimized with respect to individual objectives. It is also possible to provide needle base bodies and knives separately and in various numbers, so that several knives may be successively installed and worn on a needle body.

Additional details of advantageous embodiments of the invention result from the description, the drawings and the claims. The description is restricted to essential aspects of the invention and to miscellaneous situations. The drawings illustrate additional details and can be used by the person skilled in the art in the usual manner as supplementary to the description.

DETAILED DESCRIPTION OF THE INVENTION

Figure 1:
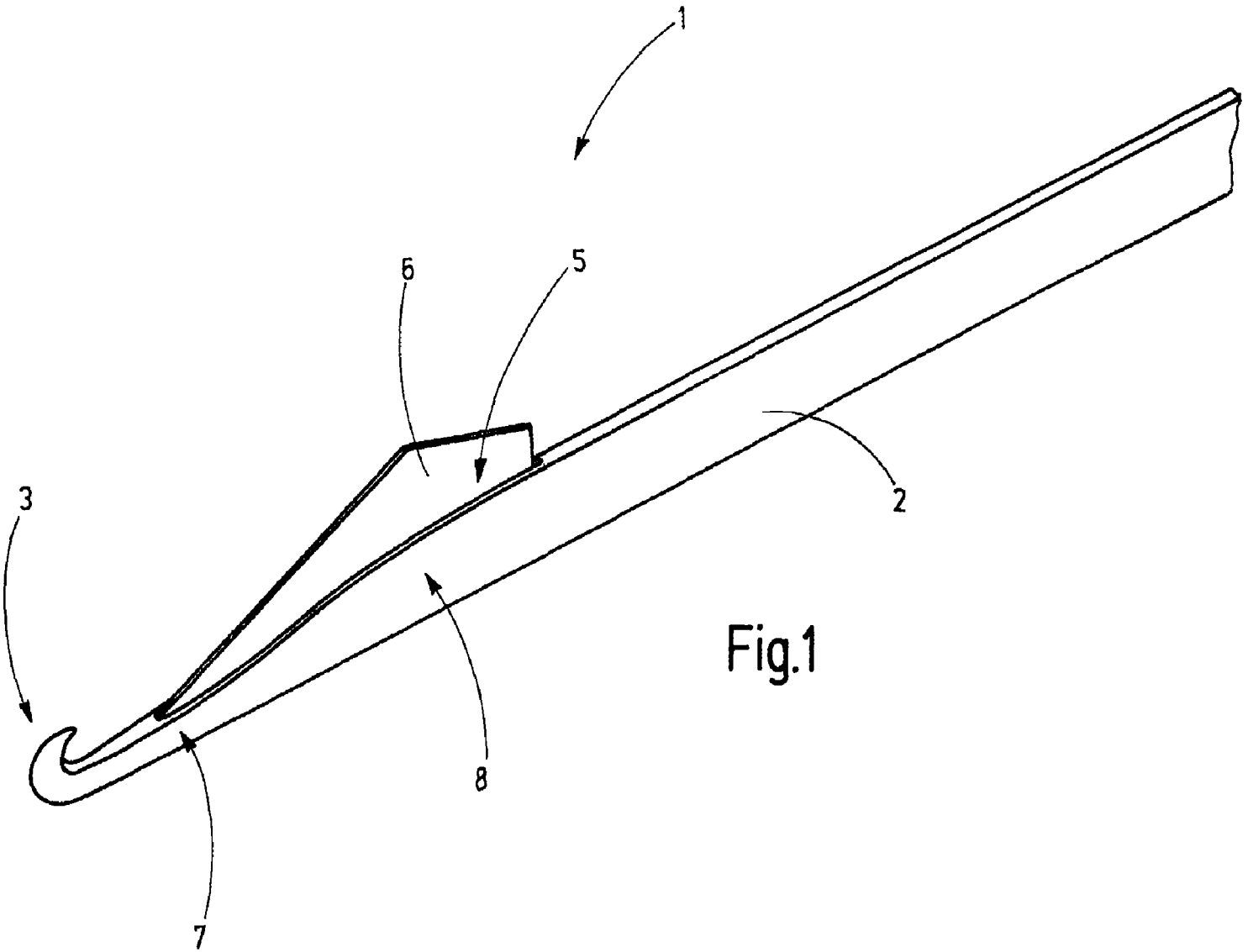
FIG. 1 is a detail of a perspective general arrangement drawing of the cutting needle in accordance with the invention.
Figure 2:
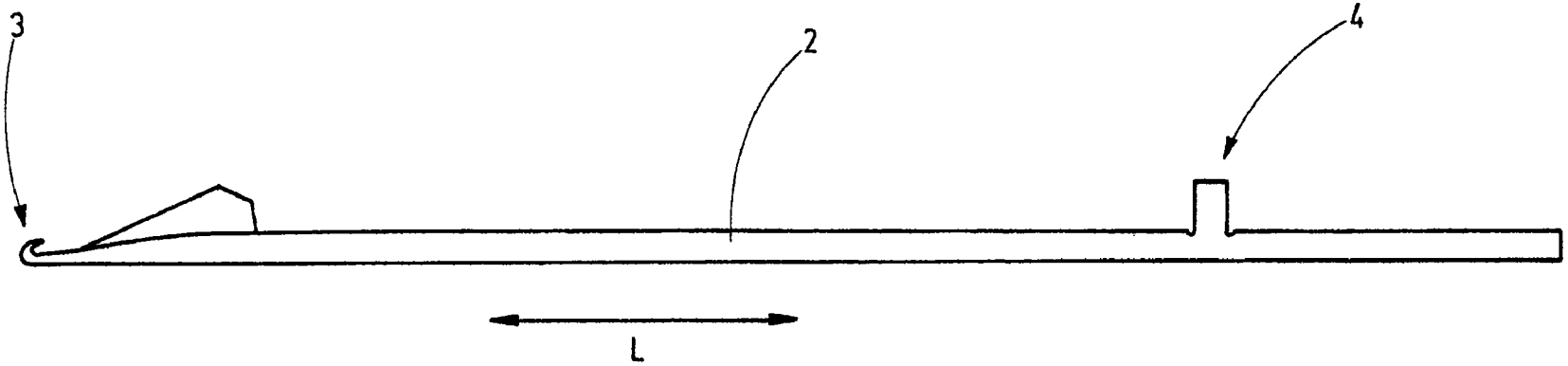
FIG. 2 is a simplified side view of the cutting needle in accordance with FIG. 1.
Figure 3:
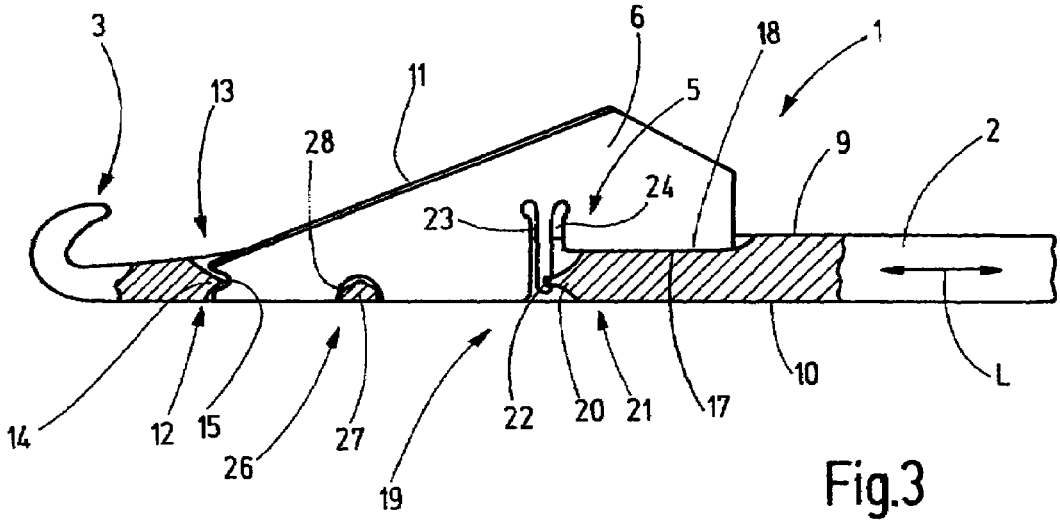
FIG. 3 is a side view, partially in section, of the cutting needle in accordance with FIGS. 1 and 2.

FIG. 1 shows a cutting needle 1 that has an elongated base body 2 with a hook 3 provided on its end. The base body 2 is disposed to connect with a drive device. To achieve this, as is shown by FIG. 2, said base body may be provided with a foot 4 at a location remote from the hook 3. This foot is disposed to interact with the needle lock of a knitting machine, as a result of which the needle body 2 is moved in axial direction in the needle channel of a needle bed, for example a dial or a knitting cylinder, i.e., in the shaft's longitudinal direction L. The needle base body 2 with a rectangular cross-section, for example, has, as shown by FIG. 1, a slit 5 in the vicinity of the hook 3, whereby a knife 6 is held in said slit. In so doing, the slit 5 preferably starts in the immediate vicinity of the hook 3 in a throat region 7 and extends beyond the needle breast 8. Said slit is straight and is delimited by two slit flanks. As is shown by FIG. 3, the slit 3, in so doing, extends from the needle upper side 9 to the needle back 10 and thus forms a breakthrough. Therefore, the slit 5 is open toward the needle upper side 9, as well as toward the needle back 10. However, it is noted that the slit 5 may also be closed toward the needle back 10, should this be necessary.

The slit 5 is used to support and secure the knife 6 which may be configured, like a razor blade, as a planar flat small blade. Thus, said knife has two flat sides that face away from each other, said flat sides being held between slit flanks without significant play. Said knife is sharpened at an edge rising away from the throat 7, so that, as illustrated, a straight or optionally differently shaped cutting edge 11 is formed there. This cutting edge preferably extends at an acute angle relative to the shaft's longitudinal direction L.

The knife 6 and the needle body 2 of the cutting needle 1 have preferably been fabricated separately and have subsequently been connected to each other. Accordingly, they may consist of different materials, for example, of different types of steel. For example, the material of the knife 6 is optimized to the extent that the wear of the cutting edge 11 is minimal in the intended situation of use. In contrast, the material of the needle base body 2 may be optimized regarding toughness or other properties. In addition, the knife 6, as well as the needle base body 2, may be provided with optimized wear-reducing coatings of different types.

Figure 4:
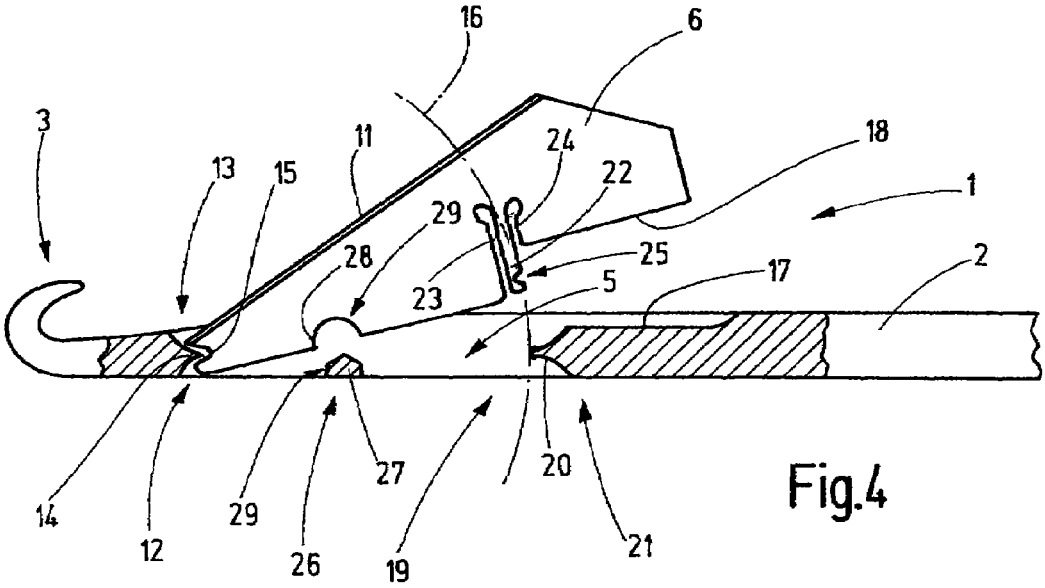
FIG. 4 shows the cutting needle in accordance with FIG. 3 while the knife is being changed.

Between the needle base body 2 and the knife 6, there is preferably at least one active positive-locking holding means 12, said holding means, for example, being arranged on the hook-side end 13 of the slit 5. The holding means 12 consists, for example, of a pre-formed first projection 14 on the end 13 of the slit 5, said projection being associated with a notch 15 provided in an associate end of the knife 6. The first projection 14 may be provided between the end surfaces of the slit 5, each of said surfaces forming a circular arc. As is shown by the comparison of FIGS. 3 and 4, the positive-locking holding means 12 forms a type of hinge that defines a hinge axis perpendicular to the plane of projection in FIGS. 4 and 5, said hinge axis being oriented transversely to the longitudinal direction L of the base body. As a result of this, the knife 6 can be pivoted into and out of the slit 5, as is indicated by the dot-dashed circular arc 16 in FIG. 4.

At a location remote from the holding means 12, the needle base body 2 has a preferably planar moment support surface 17 that acts as the bearing surface for an appropriately shaped support surface 18 of the knife 6, said bearing surface also being a flat support surface in the present exemplary embodiment. The moment support surface 17 is oriented approximately radial relative to the center of rotation of the holding means 12 and is thus oriented in a direction transverse to the circular arc 16. This surface supports the knife 6 when forces generated during the cutting of threads act on the cutting edge 11, said forces generating torques that push the knife 6 about the imaginary hinge axis of the positive-locking holding means 12 in the direction of the circular arc 16 against the moment support surface 17.

In order to secure the knife 6 in its working position in accordance with FIG. 3, a fastening means is provided, said means, in the present case, being represented by a detente device 19. The detent device 19 comprises two members that can be moved into fixed engagement, one of said members being provided on the needle shaft 2 and the other of said members being provided on the knife 6. Referring to the exemplary embodiment, these members are formed—on the side of the needle shaft 2—by a second projection 20 which is provided on the end 21 of the slit 5 remote from the hook 3. On the side of the knife 6, the detent member is represented by a tongue 22 that is an integral component of the knife 6. In the present exemplary embodiment, the second projection 20 is delimited by two arcuately curved surfaces. This second projection forms a tip extending in the direction of the hook 3.

The tongue 22 consists of the material of the knife 6. Said tongue is cleared by two slits 23, 24, i.e., it is cut out of the flat body of the knife 6 and thus forms a cleared elongated section of the knife 6. At its one end, said tongue is connected—without seam and transition—to the remaining material of the knife 6. Its other end can be resiliently moved toward and away from the notch 15. This other resiliently movable end is provided, in addition, with a recess or a notch 25 that is arranged in such a manner that it can receive the tip of the second projection 20 when the support surface 18 abuts against the moment support surface 17.

In addition, the cutting needle 1 may have an axial locking device 26 that is associated with a counter bearing 27 provided on the base body 2 and with an abutment surface 28 provided on the knife 6. The counter bearing 27 may be configured as a strip traversing the slit 5, said strip being connected in one piece with the two jaws delimiting the slit 5. The strip or counter bearing 27 preferably has a facet 29 oriented toward the hook 3. This facet is associated with the abutment surface 28 that faces away from the holding means 12 or from the hook 3. The abutment surface 28 may be part of a boundary wall of a mouth-like opening 29 that is provided on the knife 6 on the edge opposite the cutting edge 11.

The cutting needle 1 operates as follows:

During operation, the cutting needle 1 performs a reciprocating movement along the shaft's longitudinal direction L. In so doing, the hook 3 catches threads and shapes them into half-stitches or stitches. If these are pushed toward the knife 6 or if the cutting needle 1 is driven out far enough that the cutting edge 11 of the knife 6 moves through the stitch, the stitch is cut open. In addition to the other forces, a force directed away from the hook 3 is applied to the knife 6. This force pushes the abutment surface 28 against the counter bearing 27. Consequently, the force is kept away from the detent device 19. The knife 6 is securely held in the needle base body 2.

The knife is exchanged as follows:

The knife 6 is pulled out of the slit 5 and, in so doing, is pivoted as shown by FIG. 4. In so doing, the tongue 22 yields in a resilient manner and thus slides off the second projection 20. In addition, the knife 6 is pivoted away from the counter bearing 27, so that said knife can be fully lifted out of the slit 5, i.e., out of the position shown in FIG. 4. A new knife 6 is inserted in that said knife is first inserted with its hook-side end into the slit 5, so that said knife's notch 15 is placed on the first projection 14. Then the knife 6 is pivoted into the slit along the circular arc 16, whereby the notch 25 of the tongue 22 engages on the second projection 20, and the support surface 18 comes into abutment against the moment support surface 17. This operation may be performed without removing the cutting needle 1 from its needle bed.

Figure 5:
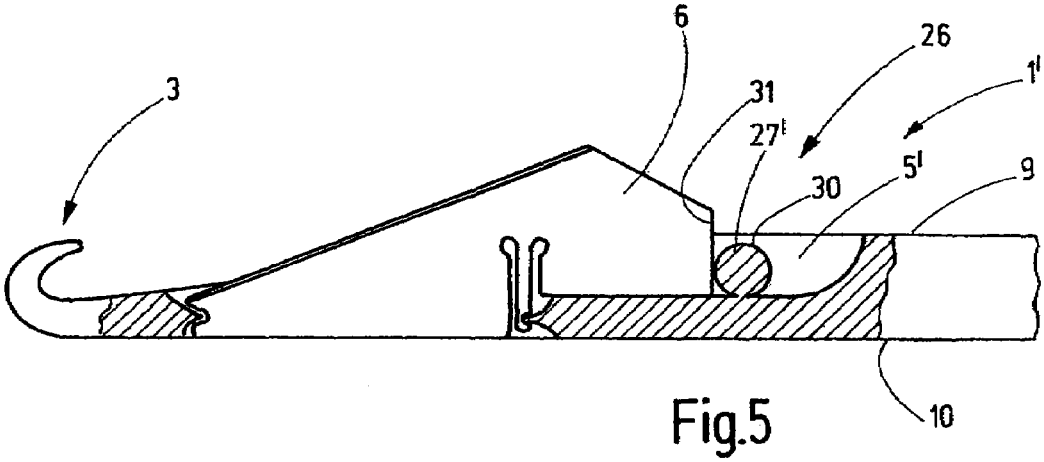
FIG. 5 is a side view, partially cut away, of a modified embodiment of the cutting needle.

FIG. 5 shows a modified embodiment, in which the axial locking device 26 is not arranged between the ends 13, 21 of the slit, as explained above, but—when viewed from the perspective of the hook 3—behind the knife 6. This embodiment is suitable, for example for cutting needles 1' having a relatively high shaft, i.e., displaying a greater distance between the needle upper side 9 and the needle back 10. The counter bearing 27' may be provided inside a slit extension 5', said counter bearing interacting with an end surface 31 of the knife 6. Thus, the end surface 31 forms an abutment surface that corresponds to the abutment surface 28. The counter bearing 27' may be a pin which is set in a corresponding opening that passes transversely through the needle base body 2. However, the pin may also be represented by projections which project, on top of each other, from the flanks of the slit extension 5'. Such half-pins my be produced similarly as in the manufacture of tongue bearings of latch-type needles.

Figure 6:
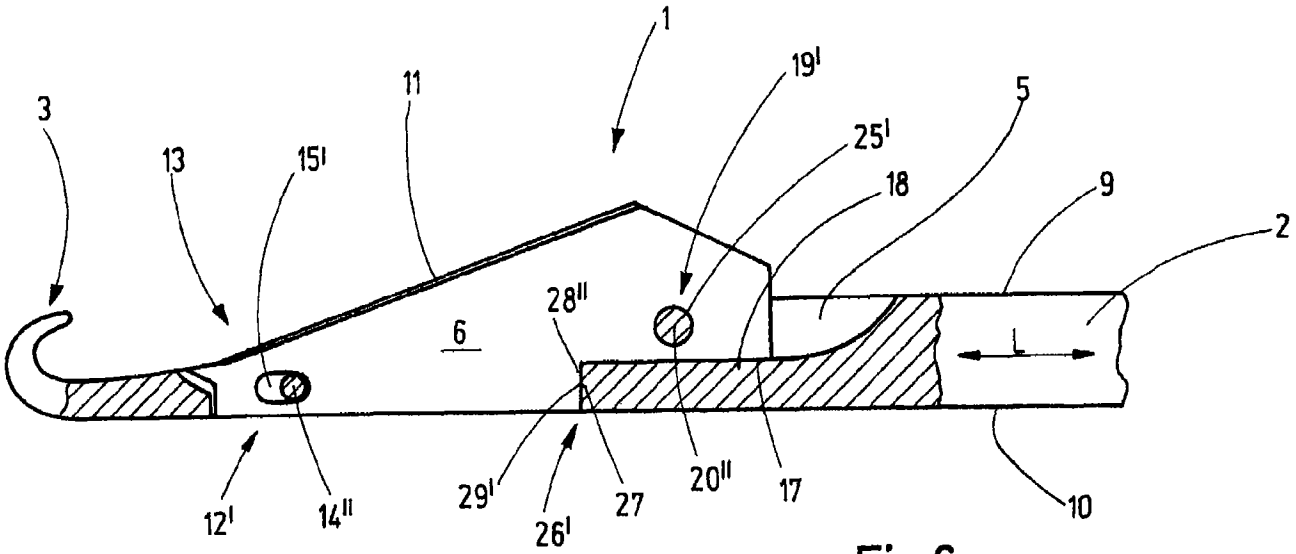
FIG. 6 is a side view, partially cut away, of a modified embodiment of the cutting needle.
Figure 7:
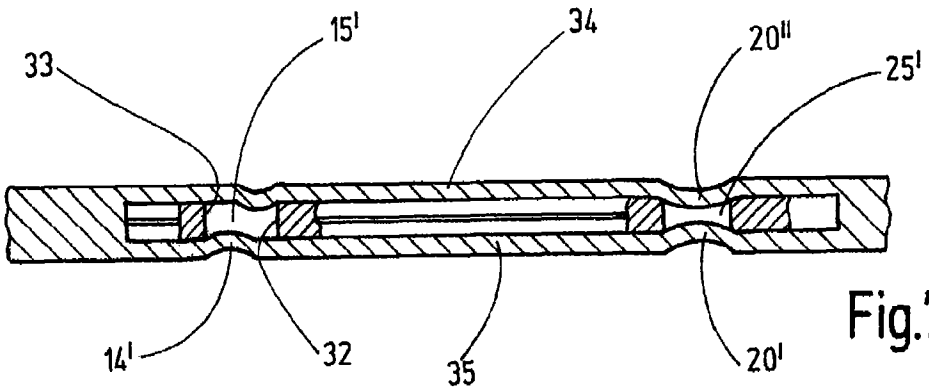
FIG. 7 is a plan view of a detail of the cutting needle in accordance with FIG. 6.

FIG. 6 shows a modified embodiment of a cutting needle 1 in accordance with FIG. 6. This cutting needle comprises an axial locking device 26', a holding means 12' and a detent device 19' that is different from the above-described means. Other than that, the same reference numbers are used as in the above description. Preferably, at least one positive-locking holding means 12' is active between the needle base body 2 and the knife 6, said holding means being arranged, for example, in the end region of the knife 6 on the hook-side end 13 of the slit 5. The holding means 12' is represented, for example, by a notch 15' having the form of an opening that extends transversely to the longitudinal direction L of the needle base body 2. A first projection 14' extending from the slit wall 34 and a first projection 14" extending from the slit wall 35 project into this opening 15 having the shape of an elongated hole (FIG. 7). In the direction of the hook 3, the elongated hole 15' is delimited by an end 33 and, on the opposite side, by an end 32. The first projections 14' and 14" may consist of the material of the slit wall 34, 35. The first projections 14' and 14" may be positioned at a distance from each other in axial direction. Referring to the exemplary embodiment in accordance with FIG. 7, the first projection 14' interacts with the end 33 of the opening 15', and the first projection 14" interacts with the end 32 of the opening 15', and thus form a positive lock with the ends 32 and 33. The surface of the first projections 14' and 14" may have the form of a spherical section and comprise a part of a spherical surface. The height of the first projections 14', 14" may be minimal and thus extend only minimally into the opening 15' of the knife 6. In order to make it possible for the knife to be snapped into the slit 5, the height and the positioning of the first projections 14', 4" are defined independent of the flexibility of the slit walls 34, 35. The great flexibility of the slit walls 34, 35 permits a great height of the first projections 14', 14" and the positioning in a near-end region of the knife 6. Stable slit walls 34, 35 require a minimal height of the first projection 14', 14", and require positioning as close as possible to the center of the longitudinal extension of the knife 6.

The detent device 19' in accordance with the exemplary embodiment in accordance with FIG. 6 is arranged at a distance from the holding means 12'. This device has essentially the same configuration as the holding means 12'. It has a notch 25' in the form of a bore which passes through the knife 6 in a direction transverse to said knife's longitudinal direction. Extending from the slit wall 34, a second projection 20" and extending from the slit wall 34 a projection 25" project into this opening 25'. Both projections 25' and 25" area equally positioned in axial direction. They are opposite each other and form a positive lock with the opening 25'. Regarding the height and the position of the second projections 20' and 20", the aforementioned criteria regarding the first projections 14' and 14" apply analogously.

In addition, the cutting needle 1 in accordance with FIG. 6 may have an axial locking device 26' that comprises a counter bearing 27' on the base body 2, and an abutment surface 28' on the knife 6. The counter bearing 27' may be a surface or an edge delimiting the slit 5. The edge or counter bearing 27' preferably has a facet 29' oriented toward the hook 3. This facet is associated with the abutment surface 28' that faces away from the holding means 12' or the hook 3.

The knife 6 of an inventive cutting needle 1 in accordance with FIGS. 6 and 7 is exchanged in that a means, e.g., flat-nose pliers (not illustrated), is used for grasping the knife 6 on its flat sides and pulling it upward in the direction of the needle upper side 9. In so doing the slit walls 34, 35 yield in a resilient manner, so that the projections 14', 14" and 20', 20" clear the openings 15' and 25' and that the knife 6 can be removed. A new knife 6 may be inserted in the free slit 5, in that said knife is inserted from the needle upper side 9 in the direction of the needle back 10 with the use of an auxiliary means, whereby the projections 14', 14", 20', 20" form a snap closure with the openings 15' and 25'.

A cutting needle 1 for knitting machines and similar applications has been provided, said cutting needle having a needle body 2 on which a knife 6 is detachably held, preferably by means of a detent device 19, 19'. Such a cutting needle 1 reduces the maintenance costs of knitting machines and discloses ways for optimizing needle bodies 2 and knives 6 in view of manufacturing technology and materials.

It will be appreciated that the above description of the present invention is susceptible to various modifications, changes and modifications, and the same are intended to be comprehended within the meaning and range of equivalents of the appended claims.

| List of Reference Numbers: | |
|---|---|
| 1, 1' | Cutting needle |
| 2 | Needle body, base body |
| 3 | Hook |
| 4 | Foot |
| L | Shaft's longitudinal direction |
| 5 | Slit |
| 5' | Slit extension |
| 6 | Knife |
| 7 | Throat region |
| 8 | Needle breast |
| 9 | Needle upper side |
| 10 | Needle back |
| 11 | Cutting edge |
| 12, 12' | Holding means |
| 13 | End |
| 14, 14', 14" | First projection |
| 15, 15' | Notch, opening |
| 16 | Circular arc |
| 17 | Moment support surface |
| 18 | Support surface |
| 19, 19' | Detent device |
| 20, 20', 20" | Second projection |
| 21 | End |
| 22 | Tongue |

-continued

| List of Reference Numbers: | |
|---|---|
| 23, 24 | Slit |
| 25, 25' | Notch, opening |
| 26 | Axial locking device |
| 27, 27' | Counter bearing |
| 28, 28' | Abutment surface |
| 29, 29' | Facet |
| 30 | Opening |
| 31 | End surface |
| 32, 33 | End |
| 34, 35 | Slit wall |

What is claimed is:

1. Cutting needle: for a knitting machine, said needle comprising a needle body that is provided, on one end, with a hook;

a knife that is detachably connected to the needle body; and wherein:

the needle body is provided with at least one holding means for supporting the knife, with the holding means consisting of a first projection disposed on the needle body and a notch disposed on the knife: a detent device is disposed to hold the knife on the needle body, with the detent device consisting of a second projection disposed on the needle body and a further notch disposed on the knife; and, the first projection and the second projection are arranged on the needle body at locations that are at a distance from each other.

2. Cutting needle in accordance with claim 1, wherein the needle body has a slit for the accommodation of the knife, and the first and second projections are disposed within the slit, are spaced from one another in the longitudinal direction of the needle body, and face one another.

3. Cutting needle in accordance with claim 1, wherein the needle body is provided with a moment support surface for the knife.

4. Cutting needle in accordance with claim 2, wherein a snap-in tongue provided on the knife is part of the detent device, and the further notch is disposed on said snap-in tongue.

5. Cutting needle for a knitting machine, said needle comprising:

a needle body that is provided, on one end, with a hook;

a knife that is detachably connected to the needle body;

a detent device disposed to hold the knife on the needle body, with the detent device including a snap-in tongue provided on the knife and represented by a free elongated section of the knife.

6. Cutting needle for a knitting machine, said needle comprising:

a needle body that is provided, on one end, with a hook;

a knife that is detachably connected to the needle body;

a detent device disposed to hold the knife on the needle body; and, an axial locking device, with the axial locking device having at least one abutment surface for the knife disposed on the needle body, said surface counter-acting an axial movement of the knife toward the detent device.

* * * * *